US007883372B1

(12) United States Patent
Sun et al.

(10) Patent No.: US 7,883,372 B1
(45) Date of Patent: Feb. 8, 2011

(54) ELECTRICAL CONNECTOR HAVING HOUSING THEREOF WITH CONNECTED GROOVES TO RECEIVE SHIELDING SHELLS THEREOF

(75) Inventors: Dao-Rui Sun, Guang-Dong (CN); Feng Zhu, Guang-Dong (CN); Kuo-Chin Lin, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/769,966

(22) Filed: Apr. 29, 2010

(51) Int. Cl.
*H01R 9/03* (2006.01)

(52) U.S. Cl. ..... 439/607.55

(58) Field of Classification Search ..... 439/607.55, 439/607.5, 607.01, 607.36, 682
See application file for complete search history.

(56) References Cited

U.S. PATENT DOCUMENTS 7,018,237 B2 * 3/2006 Zhan et al. ..... 439/607.55
7,473,136 B2 * 1/2009 Hu et al. ..... 439/607.01
7,748,999 B1 * 7/2010 Sun et al. ..... 439/79
2005/0026501 A1 * 2/2005 Zhan et al. ..... 439/607
2010/0041279 A1 * 2/2010 Sun ..... 439/682

* cited by examiner

*Primary Examiner*—Chandrika Prasad
(74) *Attorney, Agent, or Firm*—Cheng-Ju Chiang

(57) ABSTRACT

An electrical connector includes an insulating housing, a shielding shell and a plurality of terminals received in the insulating housing. The insulating housing has a protrusion, a middle of the protrusion protrudes frontward to form an inserting portion, and defines a plurality of first grooves adjacent to the protrusion and a plurality of second grooves connected with the corresponding first grooves. The shielding shell includes a first shielding shell and a second shielding shell, the first shielding shell has a plurality of arms, the second shielding shell defines an opening at a middle thereof, a plurality of splinters bent inward from fringes of the opening, the first shielding shell surrounds the protrusion and the inserting portion with the arms inserted in the corresponding first grooves, the second shielding shell surrounds the insulating housing, the splinters are inserted in the corresponding second grooves and abut against the corresponding arms.

5 Claims, 6 Drawing Sheets

ELECTRICAL CONNECTOR HAVING HOUSING THEREOF WITH CONNECTED GROOVES TO RECEIVE SHIELDING SHELLS THEREOF

BACKGROUND OF THE INVENTION

1. Field of the Invention

The present invention generally relates to an electrical connector, and more particularly to an electrical connector for connecting with a port of a miniature monitor.

2. The Related Art

An electrical connector for connecting with a port of a miniature monitor generally includes an insulating housing, a shielding shell mounted around the insulating housing and a terminal pack received in the insulating housing. In general, a shielding shell is made up of two or more shells by means of laser welding. However, the manufacturing procedure of the shielding shell described above is complex and the manufacturing cost thereof is high.

SUMMARY OF THE INVENTION

An object of the present invention is to provide an electrical connector with shielding shells and splinters of shielding shell for assembling the connector firmly, simplifying the procedure and lowering the cost of manufacturing.

The electrical connector includes an insulating housing, a shielding shell and a plurality of terminals. The insulating housing has a front wall, a middle of the front wall is protruded frontwardly to form a protrusion, a middle of the protrusion protrudes frontward to form an inserting portion, the front wall defines a plurality of first grooves adjacent to an outside of the protrusion and a plurality of second grooves connected with outsides of the corresponding first grooves. The shielding shell includes a first shielding shell and a second shielding shell, the first shielding shell has a plurality of arms extended rearward from a rear end thereof, the second shielding shell has a front board, the front board defines an opening at a middle thereof, and a plurality of splinters bent inward from fringes of the opening, the first shielding shell surrounds the protrusion and the inserting portion with the arms inserted in the corresponding first grooves, the second shielding shell surrounds the insulating housing with the protrusion and the inserting portion projecting from the opening, the splinters are inserted in the corresponding second grooves and abut against the corresponding arms. The terminals are received in the insulating housing.

As described above, when the electrical connector is assembled, the first shielding shell surrounds the protrusion and the inserting portion with the fixing arms and the top and bottom holding arms being inserted in the insulating housing, the second shielding shell surrounds the insulating housing with the splinters being inserted in the insulating housing and abutting against the corresponding arms to fasten the first shielding shell, that can not only make the insulating housing, the first shielding shell and the second shielding shell be assembled firmly, but also make the procedure simplified and lower the cost of manufacturing.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
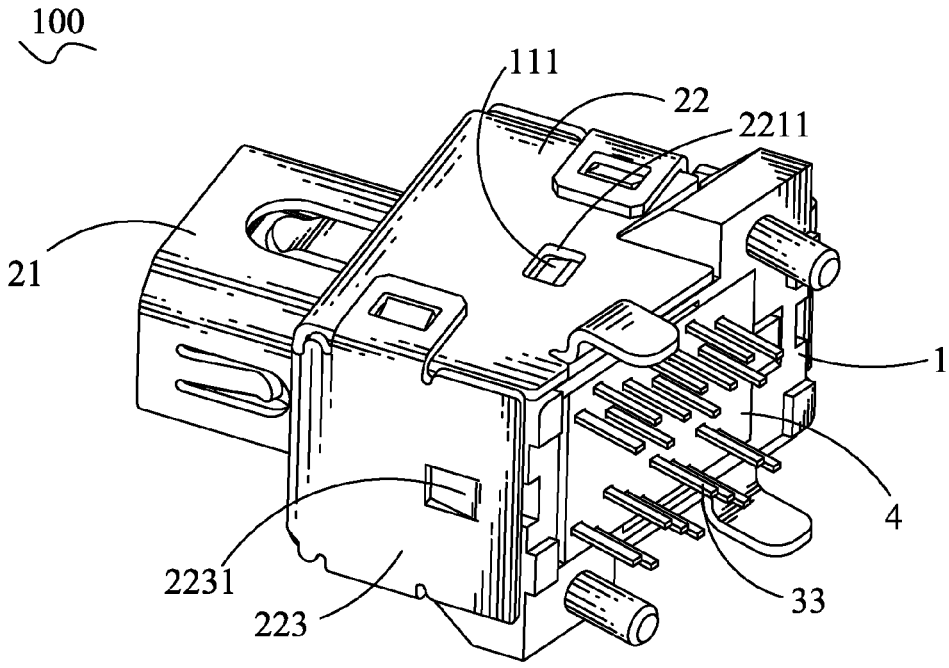
FIG. 1 is a perspective view of an electrical connector in accordance with the present invention.
Figure 2:
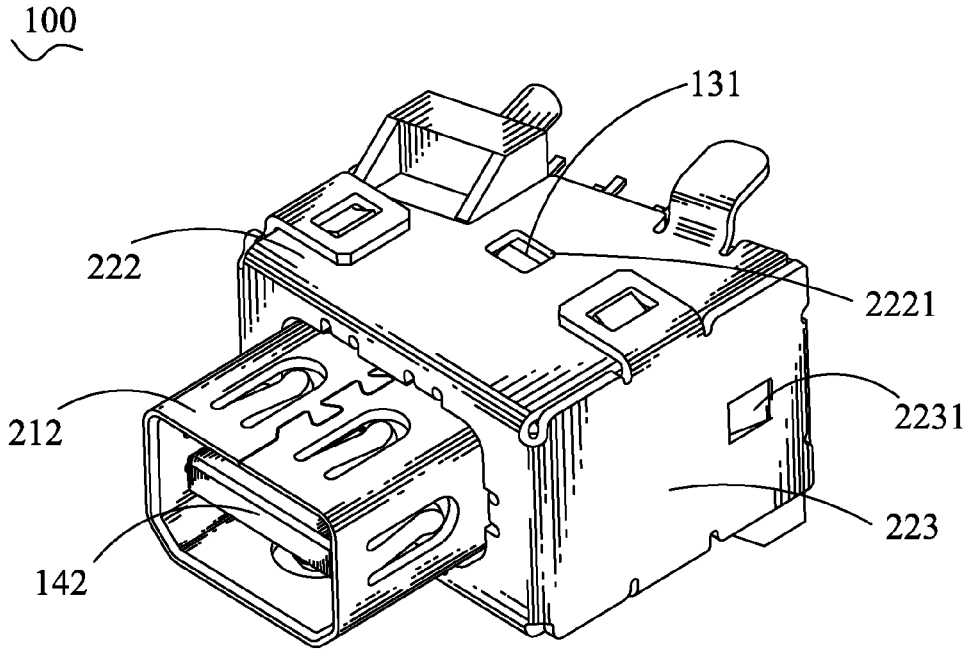
FIG. 2 is another angle perspective view of the electrical connector of FIG. 1.
Figure 3:
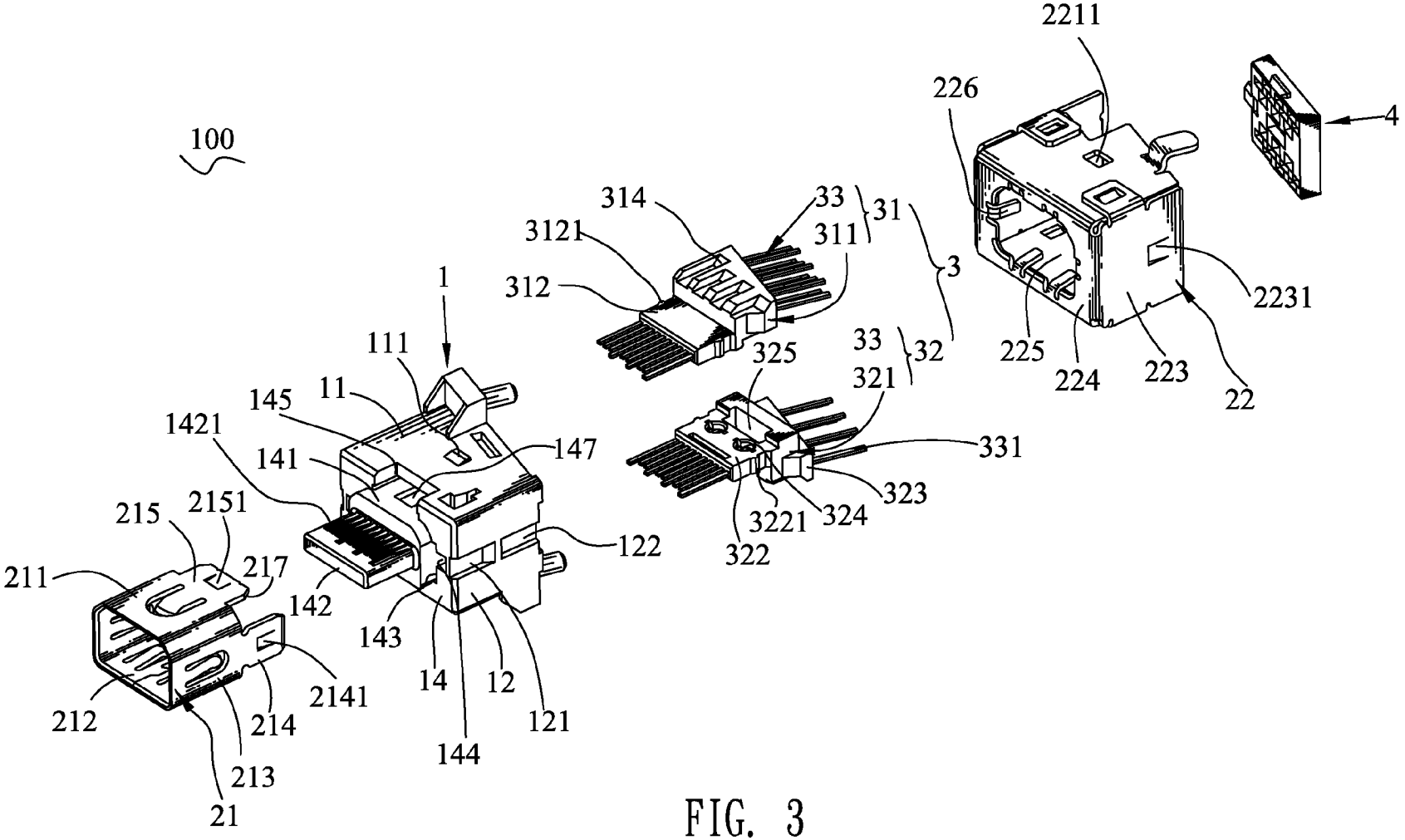
FIG. 3 is an exploded perspective view of the electrical connector of FIG. 1.
Figure 4:
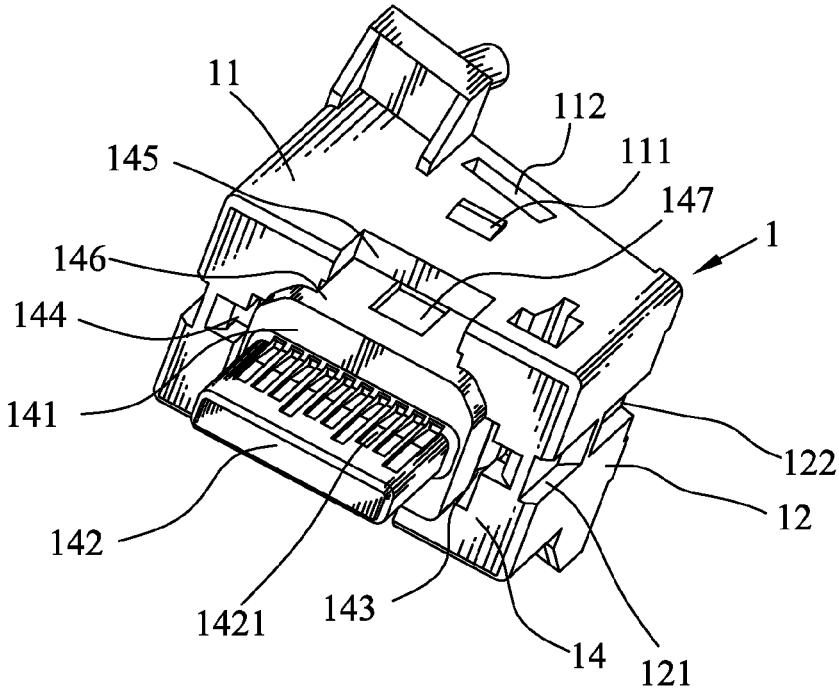
FIG. 4 is a perspective view of an insulating housing of the electrical connector of FIG. 3.
Figure 5:
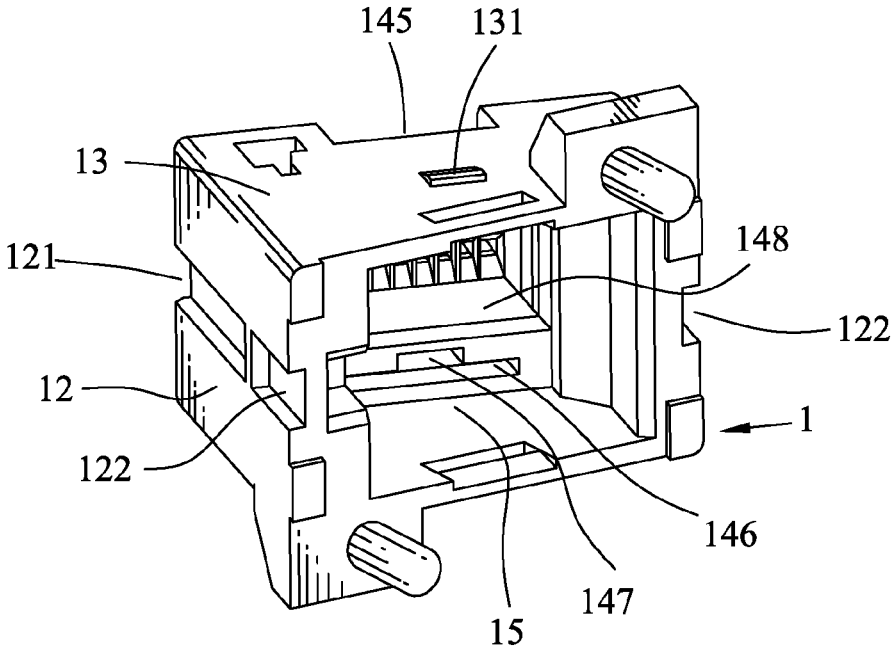
FIG. 5 is another angle perspective view of the insulating housing of the electrical connector of FIG. 4.
Figure 6:
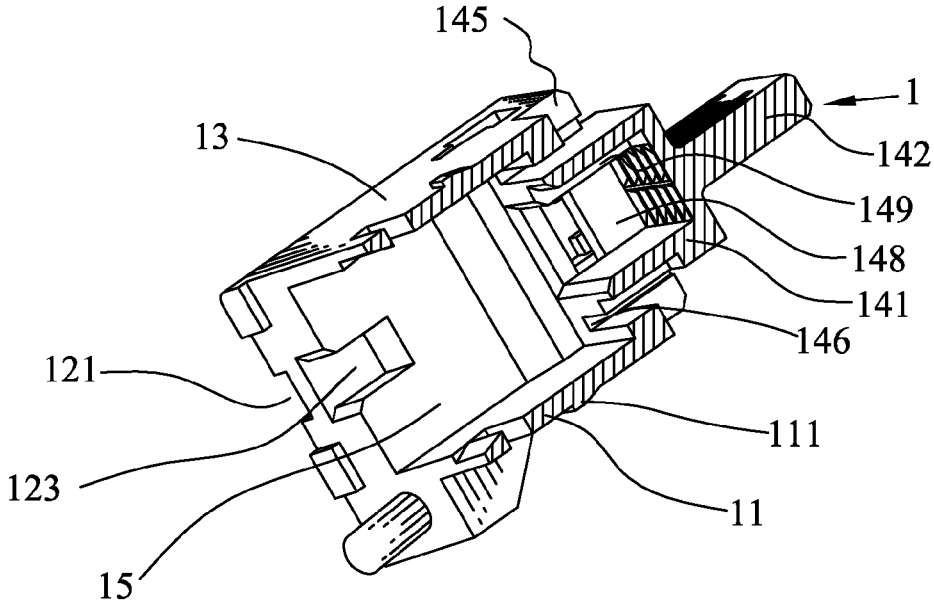
FIG. 6 is a sectional view of the insulating housing of the electrical connector of FIG. 4.

Referring to FIG. 1, FIG. 2 and FIG. 3, the electrical connector 100 according to the present invention includes an insulating housing 1, a shielding shell, a terminal pack 3 and a cover 4.

Referring to FIG. 3, FIG. 4, FIG. 5 and FIG. 6, the insulating housing 1 defines a top wall 11. Two sides of the top wall 11 respectively extend downward to form two side walls 12. A bottom wall 13 is connected with bottom edges of the two side walls 12. A front wall 14 is connected with front edges of the top wall 11, the two side walls 12 and the bottom wall 13. The top wall 11, the two side walls 12, the bottom wall 13 and the front wall 14 are interconnected to form a box shape with an accommodating space 15 thereamong. Substantial middles of the top wall 11 and the bottom wall 13 protrude outward to form two opposite locking blocks 111, 131. Each of the two side walls 12 concaves inward to define a guiding recess 121 extending longitudinally to penetrate through the front wall 14, and a holding recess 122 in alignment with the guiding recess 121 with a front end adjacent to a rear end of the guiding recess 121 and a rear end thereof penetrating through the side wall 12. A middle of the front wall 14 extends frontward to form a protrusion 141. A middle of a front of the protrusion 141 protrudes frontward to form an inserting portion 142. Top and bottom surfaces of the inserting portion 142 respectively define a plurality of terminal receiving grooves 1421 longitudinally extended to penetrate through the protrusion 141. Two sides of the front wall 14 define two locating grooves 143 extended longitudinally and adjacent to two sides of the protrusion 141, respectively. The front wall 14 defines two fixing grooves 144 extended longitudinally and connected with middles of outsides of the two corresponding locating grooves 143, respectively. Upper side and lower side of the front wall 14 define two inserting grooves 146 adjacent to a top and a bottom of the protrusion 141, respectively, and two receiving grooves 145 connected with outsides of the corresponding inserting grooves 146, respectively. The receiving groove 145 is narrower than the corresponding inserting groove 146. A portion of one inserting groove 146 is concaved inward to form a fastening groove 147. A middle of an inside of the front wall 14 is cut off to form an assembling groove 148 communicating with the terminal receiving grooves 1421 and the accommodating space 15. A middle of a bottom of the assembling groove 148 concaves inward to form a fillister 149.

Figure 7:
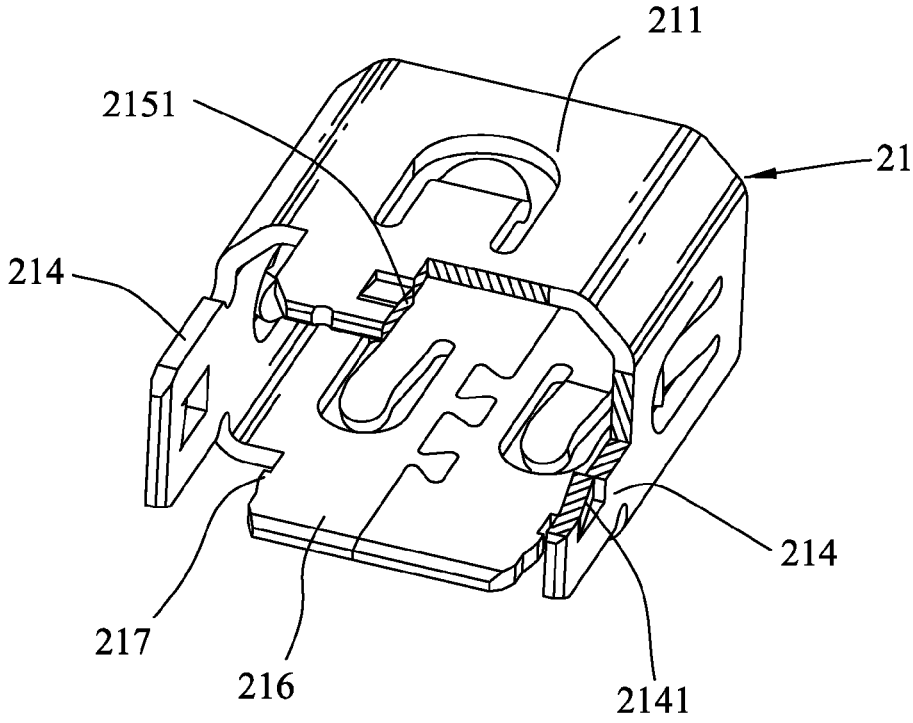
FIG. 7 is a sectional view of a first shielding shell of the electrical connector of FIG. 3.

Referring to FIG. 3 and FIG. 7, the shielding shell includes a first shielding shell 21 and a second shielding shell 22. The first shielding shell 21 includes a top plate 211, a bottom plate 212 and two side plates 213 connected with the top plate 211 and the bottom plate 212. One end of each side plate 213 longitudinally extends to form a fixing arm 214. A middle of the fixing arm 214 is punched inward to form a first locking piece 2141. One end of the top plate 211 and one end of the bottom plate 212 extend towards a same extending direction as the fixing arm 214 to form a top holding arm 215 and a bottom holding arm 216. Each of the top and bottom holding arms 215, 216 has two fixing protrusions 217 being oppositely protruded at two opposite side edges thereof, respectively. A middle of the top holding arm 215 is punched inward to form a second locking piece 2151.

Figure 8:
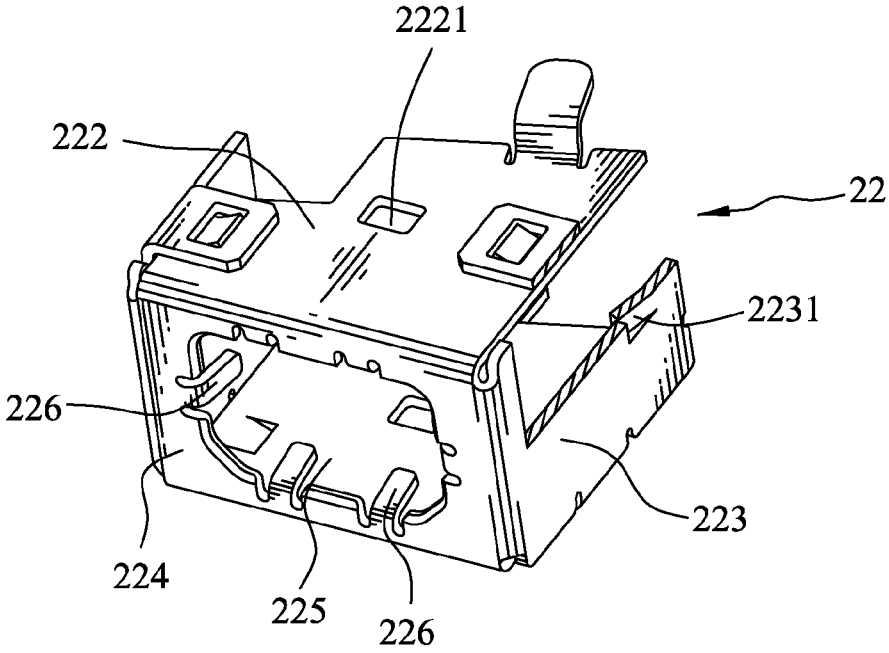
FIG. 8 is a sectional view of a second shielding shell of the electrical connector of FIG. 3.

Referring to FIG. 3 and FIG. 8, the second shielding shell 22 defines a top board 221, a bottom board 222, two side boards 223 connected with the bottom board 222 and the top board 221, and a front board 224 connected with front edges of the bottom board 222, the top board 221 and the side boards 223. Substantial middles of the top board 221 and the bottom board 222 define two fastening holes 2211, 2221. A rear portion of each side board 223 is punched inward to form a clipping piece 2231. A middle of the front board 224 is cut off to define an opening 225. A plurality of splinters 226 bent inward are arranged on fringes of the opening 225.

Figure 9:
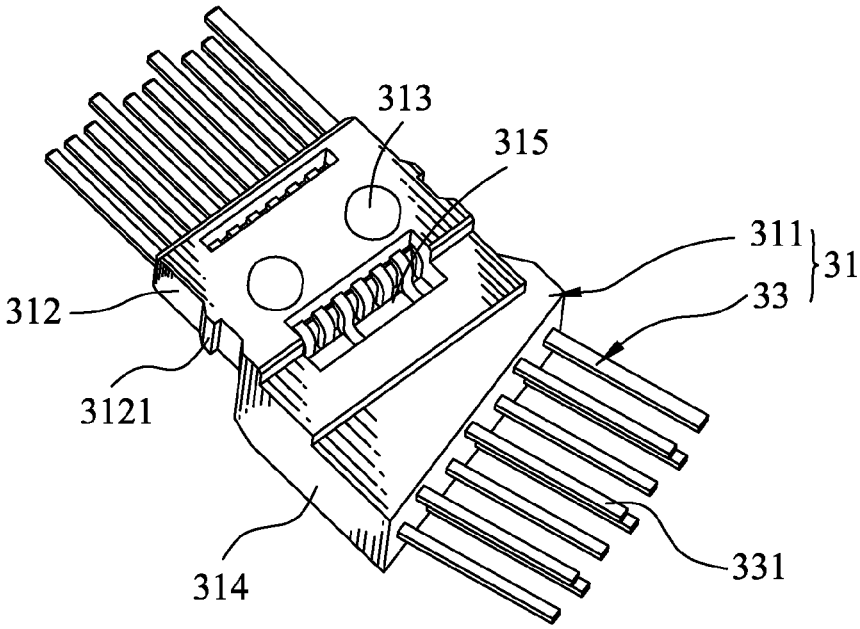
FIG. 9 is a perspective view of a first terminal pack of the electrical connector of FIG. 3.
Figure 10:
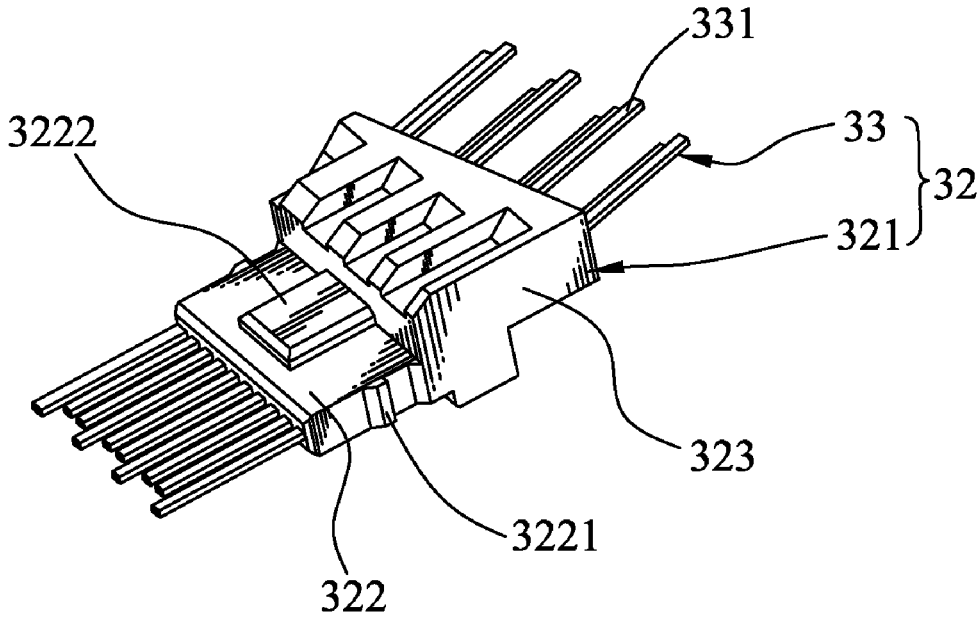
FIG. 10 is a perspective view of a second terminal pack of the electrical connector of FIG. 3.

Referring to FIG. 3, FIG. 9 and FIG. 10, the terminal pack 3 includes a first terminal pack 31 and a second terminal pack 32. The first terminal pack 31 includes a first base body 311 and a plurality of terminals 33 molded to the first base body 311. The second terminal pack 32 includes a second base body 321 and a plurality of terminals 33 molded to the second base body 321.

Referring to FIG. 3, FIG. 9 and FIG. 10, the first base body 311 of the first terminal pack 31 has a rectangular first locating portion 312 with two first buckling blocks 3121 being oppositely protruded at two opposite side edges thereof. A bottom of the first locating portion 312 protrudes downward to form two locating pillars 313 spaced from each other. One end of the first locating portion 312 protrudes upward and then extends opposite to the other end thereof to form a first fixing portion 314. The bottom of the first locating portion 312 defines a first fixing hole 315 where the terminals 33 are crooked. The second base body 321 of the second terminal pack 32 defines a rectangular second locating portion 322 with two second buckling blocks 3221 being oppositely protruded at two opposite side edges thereof. A middle of a bottom of the second locating portion 322 protrudes downward to form a locating block 3222. One end of the second locating portion 322 protrudes downward and then extends opposite to the other end thereof to form a second fixing portion 323. A top of the second locating portion 322 defines two locating cavities 324 for mating with the locating pillars 313. A top of the second locating portion 322 defines a second fixing hole 325 where the terminals 33 are crooked.

Referring to FIG. 3, FIG. 9 and FIG. 10, each of the terminals 33 is stamped from a metal plate and has a soldering arm 331. The soldering arms 331 of the terminals 33 are arranged to three equidistant layers, and the arrangement of each two adjacent layers of the soldering arms 331 is staggered. When signals are transmitted, electrical interference signals between the terminals 33 of the adjacent layers can be avoided by means of this kind of the staggered arrangement. So that a steady signal transmission can be achieved between the terminals 33.

Referring to FIG. 3, FIG. 9 and FIG. 10, the terminals 33 are respectively molded to the first base body 311 and the second base body 321, and the terminals 33 can be fastened firmly at the place of the first and second fixing holes 315, 325, so that the terminals 33 won't move. When the first terminal pack 31 is engaged with the second terminal pack 32, the bottom of the first locating portion 312 of the first terminal pack 31 connects with the top of the second locating portion 322 of the second terminal pack 32 with the locating pillars 313 of the first terminal pack 31 being inserted to the locating cavities 324. The first fixing portion 314 and the second fixing portion 323 have a space formed therebetween, so the terminals 33 molded to the first base body 311 and terminals 33 molded to the second base body 321 can keep a biggish distance therebetween. When the electrical connector 100 is in use, electrical interference signals between the terminals 33 of the first base body 311 and the second base body 321 can be avoided. So that a steady signal transmission can be achieved between the terminals 33.

Referring to FIG. 1, FIG. 2, FIG. 3, FIG. 6, FIG. 7, FIG. 9 and FIG. 10, when the electrical connector 100 is assembled, the terminal pack 3 is mounted to the insulating housing 1 by a fixture. The terminals 33 of the first terminal pack 31 and the second terminal pack 32 are inserted into the terminal receiving grooves 1421, the first and second locating portions 312, 322 of the first terminal pack 31 and the second terminal pack 32 are mounted to the assembling groove 148 of the insulating housing 1 with the first and second buckling blocks 3121, 3221 of the first and second locating portions 312, 322 abutting against sidewalls of the assembling groove 1412, the locating block 3222 of the second locating portion 322 being mounted to the fillister 149 of the insulating housing 1, the first fixing portion 314 and the second fixing portion 323 being received in the accommodating space 15. The second shielding shell 22 is mounted around the insulating housing 1 with the protrusion 141 and the inserting portion 142 projecting from the opening 225 of the second shielding shell 22. The splinters 226 of the second shielding shell 22 are received in the fixing grooves 144 and the receiving grooves 145, respectively. The locking blocks 111, 131 are inserted into the fastening holes 2211,2221 of the second shielding shell 22, the clipping pieces 2231 of the second shielding shell 22 slide through the guiding recesses 121 to the holding recesses 122 of the insulating housing 1. The first shielding shell 21 is mounted around the protrusion 141 and the inserting portion 142. The two fixing arms 214 are respectively inserted into the locating grooves 143 of the insulating housing 1 with the first locking pieces 2141 of the fixing arms 214 abutting against sidewalls of the locating groove 143. The top and bottom holding arms 215, 216 are respectively inserted into the inserting grooves 146 with the fixing protrusions 217 abutting against inner sides of the inserting grooves 146, the second locking piece 2151 of the top holding arm 215 being fastened in the fastening groove 147. The two fixing arms 214 and the top and bottom holding arms 215, 216 of the first shielding shell 21 abut against the splinters 226 of the second shielding shell 22, respectively. The cover 4 is mounted to a rear of the insulating housing 1.

As described above, when the electrical connector 100 is assembled, the first shielding shell 21 surrounds the protrusion 141 and the inserting portion 142 with the fixing arms 214 and the top and bottom holding arms 215, 216 being inserted in the insulating housing 1, the second shielding shell 22 surrounds the insulating housing 1 with the splinters 226 being inserted in the insulating housing 1 and abutting against the corresponding arms to fasten the first shielding shell 21, that can not only make the insulating housing 1, the first shielding shell 21 and the second shielding shell 22 be assembled firmly, but also make the procedure simplified and lower the cost of manufacturing.

What is claimed is:

1. An electrical connector, comprising:

an insulating housing having a front wall, a middle of the front wall being protruded frontwardly to form a protrusion, a middle of the protrusion protruding frontward to form an inserting portion, the front wall defining a plurality of first grooves adjacent to an outside of the protrusion and a plurality of second grooves connected with outsides of the corresponding first grooves;

a shielding shell including a first shielding shell and a second shielding shell, the first shielding shell having a plurality of arms extended rearward from a rear end thereof, the second shielding shell having a front board, the front board defining an opening at a middle thereof, and a plurality of splinters bent inward from fringes of the opening, the first shielding shell surrounding the protrusion and the inserting portion with the arms inserted in the corresponding first grooves, the second shielding shell surrounding the insulating housing with the protrusion and the inserting portion projecting from the opening, the splinters inserted in the corresponding second grooves and abutting against the corresponding arms; and a plurality of terminals received in the insulating housing.

2. The electrical connector as claimed in claim 1, wherein the second groove is narrower than the first groove.

3. The electrical connector as claimed in claim 1, wherein one arm is punched inward to form a locking piece, a portion of the first groove is concaved inward to form a fastening groove for engaging with the locking piece.

4. The electrical connector as claimed in claim 1, wherein the first shielding shell has a top plate, a bottom plate and two side plates, the arms include two fixing arms extended from the corresponding side plates and two holding arms extended from the corresponding top and bottom plates, the first grooves include two inserting grooves adjacent to a top and a bottom of the protrusion, respectively, for receiving the fixing arms and two locating grooves adjacent to two sides of the protrusion, respectively, for receiving the holding arms, the second grooves include two receiving grooves connected with the corresponding inserting grooves and two fixing grooves connected with the corresponding locating grooves for receiving the splinters.

5. The electrical connector as claimed in claim 1, wherein each of two side walls of the insulating housing concaves inward to define a guiding recess extending longitudinally to penetrating through the front wall, and a holding recess in alignment with the guiding recess with a front end adjacent to a rear end of the guiding recess, a portion of each side board of the second shielding shell is punched inward to form a clipping piece, when the second shielding shell is mounted around the insulating housing, the clipping piece of the second shielding shell slides through the guiding recess to the holding recess of the insulating housing.

* * * * *